US010590618B2

(12) United States Patent
Kjersem et al.

(10) Patent No.: US 10,590,618 B2
(45) Date of Patent: Mar. 17, 2020

(54) SEABED SUPPORTED UNIT AND METHOD TO PROVIDE A SHALLOW WATER DRILLING TERMINAL

(71) Applicant: Sembcorp Marine Integrated Yard Pte. Ltd., Singapore (SG)

(72) Inventors: Geir Lasse Kjersem, Bones (NO); Harald Vartdal, Slemmestad (NO); Kwang Heng Lim, Singapore (SG); Yee Chin Mary Ong, Singapore (SG); Seng Yau Khoo, Singapore (SG)

(73) Assignee: Sembcorp Marine Integrated Yard Pte. Ltd., Singapore (SG)

( * ) Notice: Subject to any disclaimer, the term of this patent is extended or adjusted under 35 U.S.C. 154(b) by 0 days.

(21) Appl. No.: 16/093,776

(22) PCT Filed: May 25, 2017

(86) PCT No.: PCT/SG2017/050270
§ 371 (c)(1),
(2) Date: Oct. 15, 2018

(87) PCT Pub. No.: WO2017/204749
PCT Pub. Date: Nov. 30, 2017

(65) Prior Publication Data

US 2019/0127939 A1 May 2, 2019

(30) Foreign Application Priority Data

May 26, 2016 (NO) ..... 20160906

(51) Int. Cl.
*E02B 17/02* (2006.01)
*E21B 7/136* (2006.01)
(Continued)

(52) U.S. Cl.
CPC ..... *E02B 17/027* (2013.01); *E02B 17/02* (2013.01); *E02B 17/025* (2013.01); *E21B 7/12* (2013.01);
(Continued)

(58) Field of Classification Search
CPC ..... E02D 23/02; E02D 27/52; E02D 25/00; E02B 17/025; E02B 17/027; E02B 17/00;
(Continued)

(56) References Cited

U.S. PATENT DOCUMENTS 3,081,600 A * 3/1963 Davidon ..... E02B 17/025 405/208
5,292,207 A * 3/1994 Scott ..... E02B 17/0021 405/207
(Continued)

FOREIGN PATENT DOCUMENTS

WO WO-2016/085347 A1 6/2016

OTHER PUBLICATIONS

Kjersem "GRAVIFLOAT Near Shore Terminal Solutions"—Singapore Maritime Technology Conference, Apr. 24, 2015.

*Primary Examiner* — Carib A Oquendo
(74) *Attorney, Agent, or Firm* — Cesari and McKenna, LLP

(57) ABSTRACT

Various embodiments relate to a method and a seabed supported base structure for providing a shallow water drilling terminal, where a prefabricated floating seabed substructure is towed to site, ballasted to rest on the seabed and/or piled to the seabed forming a seabed foundation. The seabed supported base structure is provided with at least one cantilevered unit with openings for drilling of wells, projecting sideways out from the exterior side of a vertical wall, terminated above sea level. A prefabricated floating drilling module provided with an outrigger with sidewise movable
(Continued)

drilling device is towed to the site, guided into the seabed substructure through an opening in the wall structure at the periphery of the base structure, ballasted and mated onto the base structure, whereupon wells are drilled from a drilling gear. Upon completed drilling and operation of the wells, the drilling unit is removed and substituted by a production unit.

14 Claims, 8 Drawing Sheets

(51) Int. Cl.

| | |
|---|---|
| ***E21B 7/12*** | (2006.01) |
| ***E21B 15/00*** | (2006.01) |
| ***E21B 15/02*** | (2006.01) |
| *E02B 17/00* | (2006.01) |
| *E02B 3/06* | (2006.01) |

(52) U.S. Cl.
CPC ..... *E21B 7/136* (2013.01); *E21B 15/003* (2013.01); *E21B 15/02* (2013.01); *E02B 3/068* (2013.01); *E02B 2017/0039* (2013.01); *E02B 2017/0043* (2013.01)

(58) Field of Classification Search
CPC ..... E02B 2017/0039; E02B 2017/0043; E21B 7/136; E21B 15/003; E21B 15/02
USPC ..... 405/195.1, 203, 205, 227
See application file for complete search history.

(56) References Cited

U.S. PATENT DOCUMENTS

| | | | |
|---|---|---|---|
| 6,340,272 | B1 | 1/2002 | Runge et al. |
| 2004/0151549 | A1 | 8/2004 | Roodenburg et al. |
| 2005/0217554 | A1 | 10/2005 | Steen |
| 2013/0098627 | A1 | 4/2013 | Jordan et al. |

* cited by examiner

SEABED SUPPORTED UNIT AND METHOD TO PROVIDE A SHALLOW WATER DRILLING TERMINAL

CROSS-REFERENCE TO RELATED APPLICATIONS

This application is the National Stage of International Application No. PCT/SG2017/050270, filed May 25, 2017, which claims the benefit of Norwegian Application No. 20160906, filed May 26, 2016. The contents of both applications are hereby incorporated by reference in their entirety.

THE TECHNICAL FIELD OF THE INVENTION

The present invention relates to an installation of a seabed terminal for drilling and establishing hydrocarbon wells at a distance from the shore preferably in shallow waters, where the alternative is to build a complete drilling installation resting on the sea bed or using a jacket, all with well termination on the sea bed or on a production deck. More specifically, the present invention relates to a shallow water seabed terminal for drilling and production of hydrocarbons, comprising at least one removable seabed substructure intended to be placed and resting due to gravity or piling on a seabed, forming a harbour foundation.

Moreover, the invention also relates also to a method for establishing wells for subsequent production of hydrocarbons.

BACKGROUND OF THE INVENTION

When an offshore oil or gas field is identified and decisions for exploration and production is taken, it is of importance to reduce the time taken for taking such decision till production facilities are provided and production initiated.

In order to start production, the wells have to be drilled and temporarily completed. Such drilling is made by a separate floating or fixed drilling unit. Thereupon the drilling unit is removed a production unit with complete production facilities are brought on to the side and connected to the completed wells. Until such completion is finalized, production of the hydrocarbons has to be postponed.

In shallow waters and in particular in shallow waters with soft or muddy seabed conditions, the size of the drilling or the production units may be decisive, i.e. that it only possible to float in a floating unit with partly completed topside may be floated in, the remaining part of the required top side has to be installed and built subsequent to completed float in and positioned base structure. Upon completed drilling operation, a part of the drilling facilities has to be removed and substituted by production facilities. Installation of such production facilities is complex, expensive and time consuming, increasing the time lapsed from first discovery till start-up of production.

It has previously been proposed to provide harbour sites for LNG loading at sea that either float or are placed on the ocean bottom. The floating sites have the problem in common that the platforms during drilling and production phase are subjected to movement caused by wave action. If the floating platform is intended to transfer of LNG such movement should also be kept at a minimum since the dynamics put great demands on equipment and safety if the loading takes place side by side.

To reduce the problems associated with the dynamics of the floating bodies during loading operations, it has been proposed to install large, rectangular steel or concrete structures on the seabed, functioning as artificial harbours or as a drilling and/or production facility. Typical water depths are 8-30 metres. This type of large construction is intended to be built away from populated areas and floated in and installed at the intended site, most commonly requiring proper foundation in the form of skirts intended to be forced into the sea bed soil, or intended to be piled.

NO 126927 corresponding to GB 1369915 describes a harbour site comprising a number of units that are afloat or sunk and otherwise constructed for placement on the seabed. Each unit comprises a base, load-carrying structure and moveable wave-breaking elements that can be moved according to need.

U.S. Pat. No. 3,958,426 describe a harbour site comprising a number of units placed apart on the seabed, so that at least one straight mooring location is formed. The units are provided with fenders and wave dampening devices.

Applicants own publication WO 2006/041312 discloses a harbour plant for storage, loading and unloading hydrocarbons such as LNG at sea, the whole content of which hereby being included by the reference. The harbour comprises three units built from steel or concrete, placed on the seabed. The units are placed in sidewise relation in-line. The harbour is configured to dampen the waves, the vessel being intended to lie on the leeward side of the mooring.

Applicants own publication WO 2013/002648 discloses a harbour plant for storage, loading and unloading of hydrocarbon products at sea, comprising a number of units being mutually placed on the seabed so that a harbour plant is formed. The units are placed independently at a given distance apart in sideways direction and having a front surface along which a vessel is intended to be moored, forming passage(s) for parts of the waves, and being configured to dampen a part of the incoming waves while allowing other parts of the waves and current to pass through the harbor plant.

However, a field development drilling operation for drilling and completing the wells requires one type of platform, while production from such wells require different facilities. For floating platforms anchored at the site, a drilling platform may be anchored during drilling operations and replaced by another floating platform with production facilities upon completed drilling operations. If the platform is of a type that is intended to be supported by the sea bed soil, however, such platform may either be complete with drilling and production facilities or the platform may be refurbished at the site, removing at least a part of the drilling facilities and installing the required production facilities, increasing the total costs involved.

In addition, the density, composition, consolidation and topography of sea bed soil may vary significantly for one seabed location to another. For example, the soil in river mouths will often be dominated by soft, muddy soil with a kind of yoghurt texture, while other seabed areas may be influenced or overlapped by hard sandstone, limestone or ancient volcanic rock. This will have direct impact on the load bearing capacity of the seabed soil, and hence the possibility to find a predictable and reliable foundation solution for a seabed structure which shall be resting onto the seabed.

Hence, there exists a requirement for cost-effective, versatile and flexible harbour plant systems that can store different oil related products and bunkering, and are easy to build, maintain and repair, and which can be standardized as far as possible for fabrications and cost reasons, and which can easily be deployed (installed) onto any type of seabed soil.

SUMMARY OF THE INVENTION

The invention relates to a seabed supported platform concept for both drilling after and production of hydrocarbons, comprising a base structure configured to be stably supported by the sea bed, preferably by means of a number of piles driven through purpose built sleeves in a base structure or unit. The base structure may either rest with its entire foot print on the sea bed or at least be partly, preferably completely positioned above the sea bed, the piles being the means for fixing the base structure safely and rigidly to the sea bed. The base structure is configured in such way that it is possible to float in a floating drilling unit and/or upon completed drilling operations remove the floating drilling unit and replace it with a floating production unit and the ballast either of such structures to rest stably on the base structure, preferably due to its own weight (gravity) or alternatively also secured by means of locking devices, locking either structure to the base structure.

The base structure or the substructure may also be configured to serve as a safe haven for drilling or production unit or for a storage module, said units or module being removable arranged on top of the base structure, forming a seabed unit, and at least one seabed unit constituting a seabed terminal.

The invention relates also to a method for developing oil fields in more or less, but not necessarily shallow waters and/or at sites with muddy or soft sea bed conditions, where at least the drilling facility unit, but possibly also the production facility may be removed upon completed operation and used on another field, the base structure then serving as for example as a harbour cite or the like.

An object of the present invention is to provide a versatile shallow water seabed supported unit, fixed base structure with drilled and completed well heads above sea bed and with the possibility of quick start up of production of hydrocarbons for the drilled and completed wells.

The principle used according to be present invention is to use a piled base structure where a major part of the weight of the base structure and possibly also a floatable module to be berthed in and supported by the base structure are carried by piles, extending to a sufficient depth into the seabed soil in order to carry and withstand all downward, upward or sideward loads, weights and forces acting on the base structure. In this respect the base structure may either rest on the seabed with at least a part of its foot print or the base structure may be positioned at a distance more or less well above the seabed soil, i.e. without really being in contact with the seabed soil, all loads, weights and forces being taken by the piles. In such case the base structure will not cause a negative or detrimental effect of the sea bed life below the base structure.

Moreover, the system and the method according to the present invention may be based on the principle that a temporary arrangement of piles is used for supporting the base structure during the installation phase, said temporary pile arrangement taking all loads, weights and forces during the piling operation until a permanent pile arrangement is established and the base structure is permanently supported by the permanent piles piled into seabed, so that the piled structure is able to withstand all load criteria, such as a 100-year storm or surge.

It should be appreciated that the installed temporary piles may, or may not, be removed or cut off upon completed installation of the substructure. If the temporarily supporting piles are to be removed, the piles should preferably be cut off at a depth where the cut off piles do not constitute a hazard to the operation of the base structure and the floatable module and/or vessels to be berthed in and supported by the seabed substructure.

Such concept is disclosed in the applicants' international PCT application PCT/NO2015/050156, filed on Sep. 8, 2015, the whole content of which is hereby included by the reference. Reference is also made to the applicants' Norwegian patent application No. NO 20160518, filed on Apr. 1, 2016, disclosing a piling method for widening the installation window and the allowing piling in more severe weather conditions, the content of which hereby being included by the reference.

An object of the present invention is to provide a solution for increasing the spread of wells from an installed drilling platform, increasing the number of wells that may be drilled from one single platform.

Yet another object of the present invention is to establish production wells from a single platform, well away from production areas on the deck super-structure.

Yet another object of the present invention is to provide a plant where the as much of the well head facilities for all the wells to be drilled from the platform, such as casings through the water line etc., are preinstalled, allowing drilling to be initiated at an earlier point in time.

A further object of the present invention is to provide a shallow water seabed drilling and/or production facility which is flexible, cost effective and easy to establish in most types of seabed soil conditions.

Another object of the invention is to provide a near shore storage system which may, when required, also be located in extremely soft and muddy soil as found in river deltas and seabed areas of unconsolidated soil where gravity based structures cannot be installed or will be prohibitively expensive.

Yet another object of the invention is to enable building of each of the units of the seabed terminal at reasonable price and efficiently and as complete as possible at a traditional construction site, preferably at a dockyard with the use of a dry dock. Thereby, the costly finishing work at sea will be minimised. After final outfitting at the building site, each of the units is brought or towed to the installation location, finally to be lowered down with the use of known techniques.

It is also an object of the invention to ensure safe transfer of large vertical loads into the seabed, generated by storing large volumes of liquids above sea level.

It is also an object of the invention to provide a quick and safe installation of the storage module with topside equipment.

Yet another object of the present invention is to provide a drilling scheme that allows for early start-up of drilling activities, prior to arrival at side of the drilling unit.

The objects of the present invention are achieved by a shallow seabed drilling and production plant and a method for establishing such drilling layout as further defined by the independent claims. Embodiments, alternatives and variants of the invention are defined by the dependent claims.

According to the present invention, a facility for drilling and production of hydrocarbons is provided, comprising at least one removable seabed substructure intended to be supported by the sea bed, preferably by means of piling, forming a supporting foundation. The seabed substructure comprises a base structure, provided with buoyancy devices, an upwards extending wall structure from the base structure, provided with buoyancy devices, arranged along at least a part of the periphery of the base structure, at least one opening in the wall structure for introducing a floatable drilling module, retractably arranged on top of the base structure and within the wall structure, and where the upwards extending wall structure is provided with one or more pre-installed sections or outriggers, intended to be used for drilling wells through the preinstalled and preferably pre-outfitted sections.

The at least one pre-installed and preferably pre-outfitted section is rigidly fixed to the outer surface of the wall structure, forming a cantilevered section and preferably having an upper surface that is flush with the upper surface of the wall section.

According to an embodiment of the projection outwards from the wall section is provided with a number of prepared, open casings, extending through the pre-installed section, ready for drilling once the drilling unit is in position.

Accordingly, the drilling unit may be provided with a corresponding outrigger, with a drilling rig being configured to move outwards and inwards and sidewise on order to cover all preinstalled and pre-prepared casing in the section projecting outwards from the side wall(s) of the base structure.

The sea bed substructure may have U-shape and is provided with prepared outwards projecting sections with well points for drilling preferably on three sides of the U-shaped base structure.

The various objects are also solved by a method for drilling and producing hydrocarbons by providing and installing a base structure, intended to berth a drilling terminal or unit, allowing the terminal, base structure or unit to be supported by the sea bed, preferably by means of a number of piles, forming a seabed supported foundation. The method comprises forming at least one outwards projecting cantilevered unit with pre-fabricated, hollow casings extending completely through the cantilevered unit for drilling through. Moreover, a floating drilling unit (a floating drilling module) with an outrigger with a drilling device is berthed on the base structure through an opening in the wall structure and ballasted and mated onto the seabed base structure, whereupon the drilling device is moved relative to the drilling module out and over the cantilevered unit and brought into position over a casing whereupon drilling operation is started, drilling wells from the drilling device on the outrigger of the deck.

Upon completion of one well through the cantilevered unit, the drilling gear may be moved onto and over a next casing in the cantilevered unit.

Upon completion of the drilling operation for all casing on the cantilevered unit, the drilling device is retracted, the floating drilling unit is towed out from its berthing, turned 90 degrees, so that the movable drilling device is aligned with a next cantilevered unit, whereupon the drilling device is moved out and on top of a first new casing whereupon drilling operations are initiated.

Upon completed drilling of all casings on the second cantilevered unit, the floating drilling unit is removed from its berthing in the base structure, turned 90 degrees and the re-berthed, whereupon drilling operations are initiated as described above.

An advantage of the present invention is that the time taken from start of drilling until start production on a complex scale, at least in shallow waters is reduces substantially. Moreover, at least the drilling unit, but also the production unit may be re-used at other location when at least the operation and possibly also production has terminated.

In addition this feature of the piled foundation is also very useful when the storage system according to the invention is installed in shallow cyclone and storm surge exposed areas, where water levels in extreme 100 years cases may rise as much as 8-9 meter above normal sea level.

Another important advantage of using the piles according to the present invention is that the piles may take both tension and compression, and at the same time in an efficient and cost effective manner allow for pile length of varying lengths as dimensions. The number, positions and dimensions of the ducts or sleeves may be configured in such way that extra, unused ducts or sleeves are provided in case further piling is required at a later stage.

The seabed unit of the seabed terminal may be designed to take very large vertical loads onto the seabed from large weights of liquids stored inside the storage module without any motions of the seabed terminal, typically up to, but not limited to 150,000 tones deadweight, corresponding to the capacity of a large tanker ship. Some of this capacity may be obtained by increasing the height of the storage volume while maintaining the horizontal footprint of the seabed terminal.

Another advantage is that the seabed substructure according to the present invention does not necessarily have to rest on the seabed, the weight, forces and loads being carried by the piles. Moreover, the seabed substructure is not dependent on use of skirts in order to resist tension, i.e. uplift of the structure caused for example by storm surge. Hence, the underside of the base structure does not need to have any load bearing contact with the seabed soil and the variable, operational and environmental loads of the sea terminal is taken up by the piles.

Sufficient bearing and supporting capacity may be obtained, depending on the load bearing capacity, achieved by means of the shear force between the pile surfaces and the corresponding wall surface of the grouted ducts or sleeves. Because of the grout in the annulus formed between the outer pile surface and the surface of the ducts or sleeves, required shear resistance is obtained to resist produced shear forces acting in this joint.

By being in position the base structure above the sea bed the environmental effect of the base structure on the marine seabed life is eliminated or substantially reduces.

The key area for the invention would be to have a quick and safe installation of the storage module with topside equipment. This is the costly part (90-95%) of the entire installation. By having a pre-installed base foundation, which is either gravity stabilized or preferably piled and leveled in advance to the seabed, then the installation of the storage module can take place in a few hours.

SHORT DESCRIPTION OF THE DRAWINGS

The device according to the invention can be explained in more detail in the following description with reference to the enclosed figures, wherein.

Figure 16:
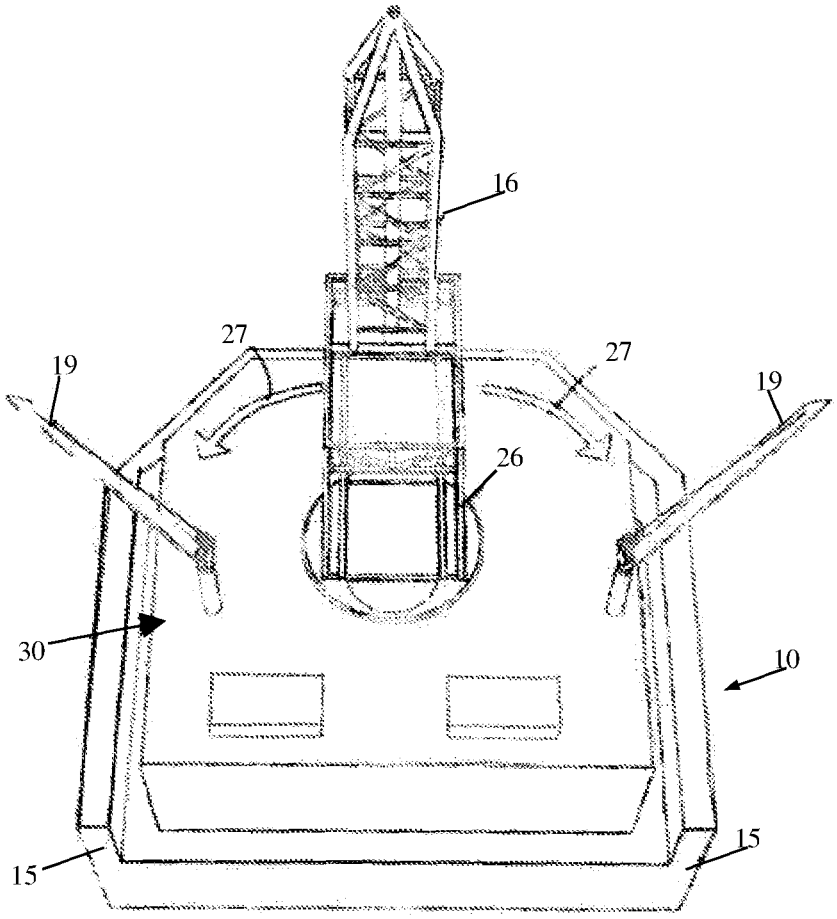

FIGS. 14 A-C show schematically a plan view from above and from one side of an embodiment of a base structure according to the present invention;

FIGS. 15 A-D show schematically views of an alternative shape of the floating structure to be berthed and possible corresponding modifications to the base structure; and FIG. 16 shows schematically a view in perspective of an alternative solution where the drilling derrick is arranged on a cantilever rail system, where both the drilling derrick and cantilever rail system also may be rotated around a vertical axis of rotation.

DETAILED DESCRIPTION OF THE DISCLOSED EMBODIMENTS

The following description of the exemplary embodiment refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to a method for installation of a base structure on a seabed in general and preferably, but not necessarily on a sloped seabed and/or on a seabed with a low bearing capacity; use of a removable drilling unit for drilling the wells to be drilled, berthed on the base structure, where the drilling unit is de-berthed upon completed drilling of the wells on one side of the base structure, towed out and turned 90 degrees and the re-berthed for drilling the well on a second side of the base structure, de berthed, towed out and turned yet another 90 degrees and re-berthed for drilling the wells on the remaining side of the base structure; removal of the drilling unit upon completed drilling operations; and berthing a production and storage unit for production of hydrocarbons from the completed wells.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment.

The key area for the invention is to provide a quick and safe installation of the storage module with topside equipment for production of hydrocarbon where the base structure is stably and rigidly supported during the piling operation of the permanent piles and when adequately piled, serving as a berthing station for a removable drilling unit and subsequently a production unit. This is the costly part (90-95%) of the entire installation. By having a pre-installed base foundation, which is stabilized at least by means of piles and leveled in advance to the seabed, and then berthing a drilling unit for drilling wells on three sides of the base structure and subsequently replacing the drilling unit with a production unit, then the time taken from discovery of hydrocarbons till start-up of production of hydrocarbons may be minimized considerably, making the field more profitable.

In addition, the present invention offers the possibility of establishing a seabed terminal on different soil conditions in an expedient manner. The density, composition, consolidation and topography of seabed soil may vary significantly for one seabed location to another. This will have direct impact on the load bearing capacity of the seabed soil, and hence the possibility to find a predictable and reliable foundation solution for a seabed structure which shall be supported by the seabed. According to one embodiment, the based foundation may be in the form of a semi-submersible floating body, piled to the seabed. In this case the base substructure can be ballasted as a semi submersible structure and piled to the seabed through the base structure and possibly, but not necessary, the wall structure of the seabed substructure. It is important in these cases to have an efficient transfer of vertical structural forces, it is an advantage that the main structural beams of the base structure and the storage module has mirrored structural interfaces. This means that vertical forces from the bulkheads storage module are preferably transferred directly into the main structural beams of the base structure and into the piling structure and to the seabed. Tests has shown that the piled seabed substructure must tolerate and stand a weight of 100 000-120 000 tons.

Figure 1:
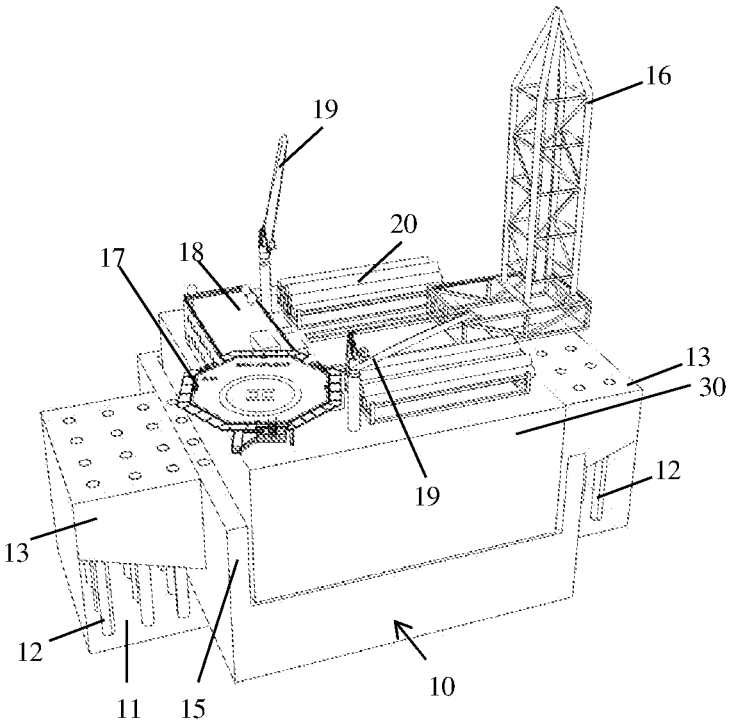
FIG. 1 shows schematically in perspective an embodiment of the base structure and a drilling unit berthed on the base structure, the mated units resting on the sea bed, with the wells on the left cantilever unit being drilled and where the wells on the opposite side is in the process of being drilled.

FIG. 1 shows schematically in perspective an embodiment of the base structure 10 and a drilling unit 30 berthed on the base structure 10, the mated units resting on the sea bed 11, with the wells 12 on the left cantilever unit 13 being drilled and where the wells 12 on the opposite side is in the process of being drilled. The base structure is stably fixed to the sea bed 11 by means of a number of piles. The piles and their fixtures to the base structure 10 may be as described in applicants' co-pending application no. PCT/NO2015/050156, filed on September 8, said PCT application hereby being included by the reference with respect to the piles, their fixture to the base structure and the method for establishing stable support of the base structure 10 to the sea bed 11. Reference is also made to the applicants' co-pending Norwegian application no. NO 2016/0518, filed on Apr. 1, 2016 regarding the method and system for piling the base structure 10 to the sea bed 11. It should be appreciated that both the base structure 10 and the drilling unit are configured in such way that these two units are floatable and having devices for controlling the stability, such devices being well known to the skilled person and shall not be described in further detail.

As indicated in FIG. 1, the drilling unit 30 is provided with a drilling rig 16, a helideck 17, living quarter 18, cranes 19 and storage areas for storing casings 20 to form a part of the wells 12 to be drilled. It should be appreciated that the drilling rig 16 is movably arranged both in and out and in transverse direction.

The base structure 10 is provided with a system (not shown) for ballasting and is preferably made from steel, although also other materials can also be used such as concrete. It should be appreciated that the drilling unit 30 and the production unit 50 according to the present invention also may be provided with means, such as loading systems, cranes, winches etc. on top of the storage module. When either the drilling unit 30 or the production unit 50 arrives at the site, it is mated with the seabed substructure or base structure 10. During this mating operation, the floating module is maneuvered in through the opening at one end of the base structure and in between the two parallel upwards extending side wall structures 15. The floating unit 30 or 50 is guided on top of the base structure 10, within the wall structure 15. The floating unit 30 or 50 is the ballasted so that it rests stably on the base structure 10, forming a seabed assembled unit.

Figure 2:
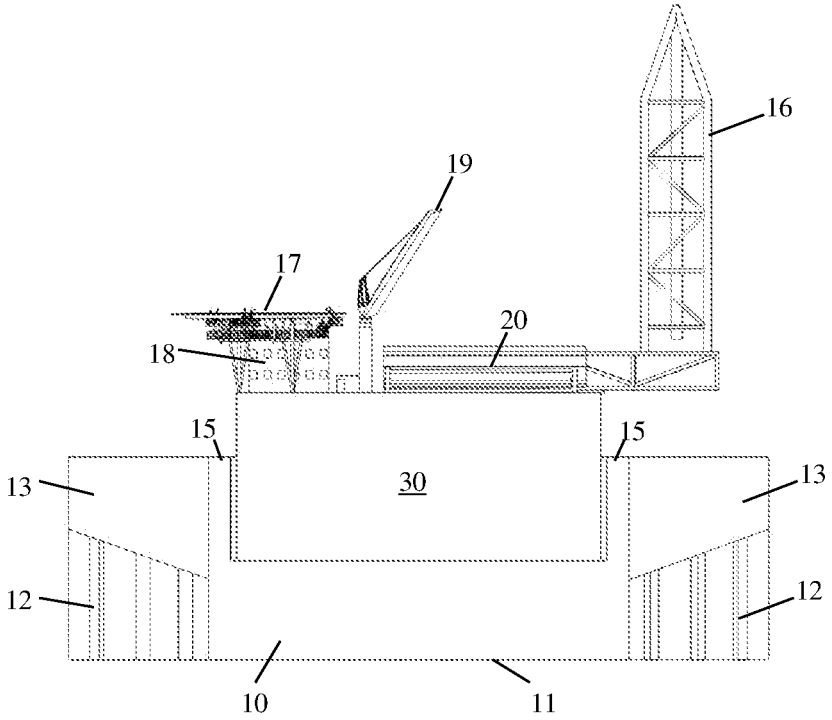
FIG. 2 shows schematically a side view of the assembled embodiment, shown in FIG. 1.

FIG. 2 shows schematically a side view of the assembled embodiment, shown in FIG. 1, showing the drilling unit 30 in berthed state on the base structure 10.

Figure 3:
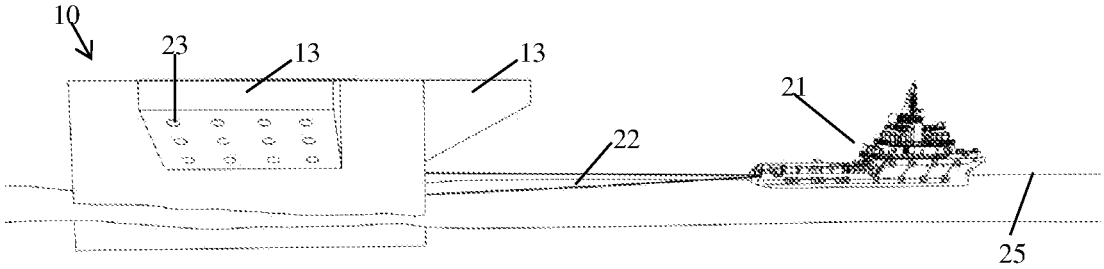
FIG. 3 shows schematically a base structure towed by a towing vessel to the installation site.
Figure 4:
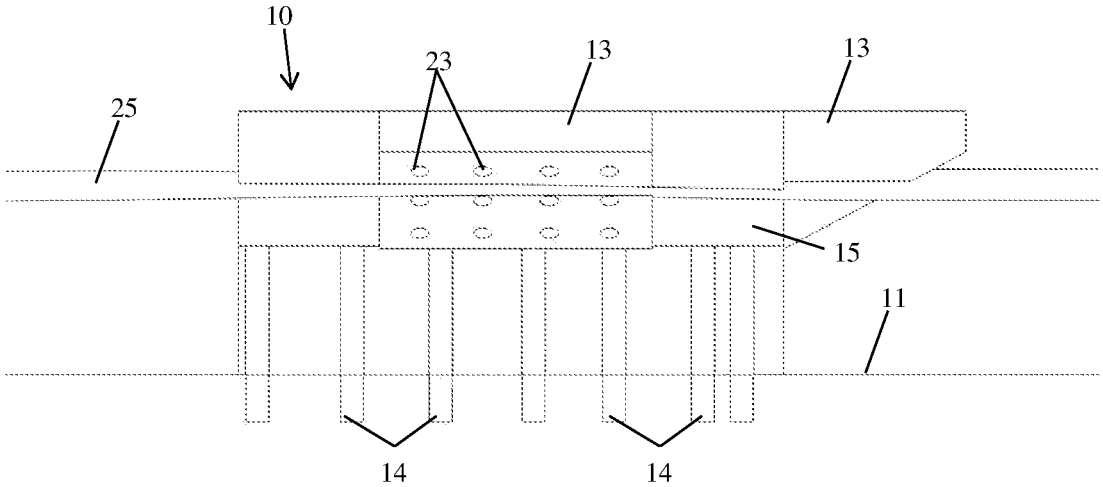
FIG. 4 shows schematically a base structure according to the invention, installed at the installation site, supported by the sea bed by means of a number of piles piled into the sea bed, and with the bottom surface arranged above the sea bed surface.

FIG. 3 shows schematically the base structure 10 towed by a towing vessel 21 to the installation site, while FIG. 4 shows schematically the base structure 10, installed at the installation site, supported by the sea bed 11 by means of a number of piles 14, driven into the sea bed 11 soil, and with its bottom surface arranged above the sea bed 11 surface. Moreover, the Figure also indicates that the base structure 10 is provided with cantilevered units 13, extending outwards from the side walls 15 on three sides of the base structure 10, the fourth side being open to enable the drilling unit 30 to be maneuvered into the base structure and berthed in between the three vertical walls 15 of the base structure 10. It should be noted that the cantilevered units form an integrated part of the vertical wall structure 15, configured to take the appearing loads, forces and moments occurring. Moreover, the cantilevered units are provided with holes or ducts 23, extending through the cantilever units 13 for receiving the drill strings and the casings used as part of the drilling operations.

According to the embodiment shown in the FIGS. 1 to 4, the cantilevered units 13 are provided with a skewed bottom plate, the bottom plate or surface of the cantilevered units 13 being inclined outwards and upwards from its fixture on the side wall 15.

The seabed substructure 10 may be provided with a bottom structure (not shown) and with an upward extending wall structure 15 arranged along at least a part of the periphery of the base structure 10. The wall structure 15 forms an integrated part of the bottom structure, together forming a base structure 10. Both the bottom structure and wall structure 15 are provided with buoyancy devices (not shown). Such buoyancy means may be in the form of tanks and compartments in the bottom structure and in the upwards extending wall structure 15. The upwards extending walls 15 extend along three sides of the base structure 10, thereby providing an opening in the wall structure for introducing a floatable drilling or production unit 30, 50 in over the bottom structure. The drilling and production units 30, 50 are removably arranged on the base structure 10 within the wall structure 15, said units together forming a drilling or production seabed unit 30, 50.

The seabed substructure 10 is floating and has means for ballasting (not shown) and is intended to be placed on or just above the seabed 11, supported by a number of piles 14 or optionally, also resting on the seabed 11 due to gravity, fixed by means of piles. The upward extending wall structure 15 of the substructure 10 has perforations or ducts/sleeves through the wall structure for optional and/or additional piling, and also there are perforations in the base structure 10 for receipt of piles 14. The ducts and accessories for receiving the piles 14 will be described in further details below. A vessel (not shown) with machines and tools for piling is moored next to the wall structure 15 to perform the piling operations. As indicated in FIG. 1, piles 14 are arranged both in longitudinal and transverse direction along the foot of the three walls along the submerged front beam beneath the opening of the base structure 10, and along the internal walls 15 forming the upwards open compartments 23. In such a way the entire footprint or at least parts of the footprint may be provided with piles for supporting the base structure 10 properly. The number of piles 14 used and their position, diameter and length depend on the weight to be supported and on the seabed soil condition.

An advantage according to the present invention is that the seabed substructure 10, constituting a part of the seabed unit 30 for floating modules, such as a floatable LNG storage unit or barge according to the invention, can be lowered down to installed offshore or near shore, be removed, be moved and be replaced to form new individual configurations as required using known techniques.

Figure 5:
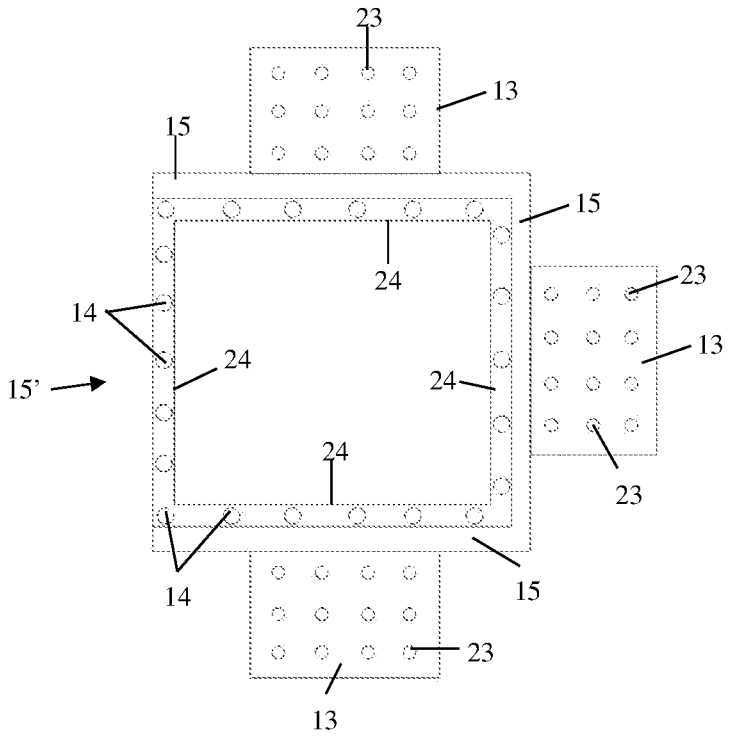
FIG. 5 shows schematically a top view of the base structure shown in FIG. 3 in piled state.

FIG. 5 shows schematically a top view of the base structure 10 shown in FIG. 3 in piled state. As shown the base structure 10 is piled to the sea bed by means of piles 14 along its entire periphery. Moreover as shown, the base structure 10 is provided with a cantilevered unit 13 arranged on each of the three side walls 15, with the fourth side being provided with an opening 15' dimensioned and configured to allow the drilling unit 30 or the production unit 50 to be floated in and rest on a submerged bottom slab or beam 24 extending internally around the periphery of the wall structure 15, 15'.

Figure 6:
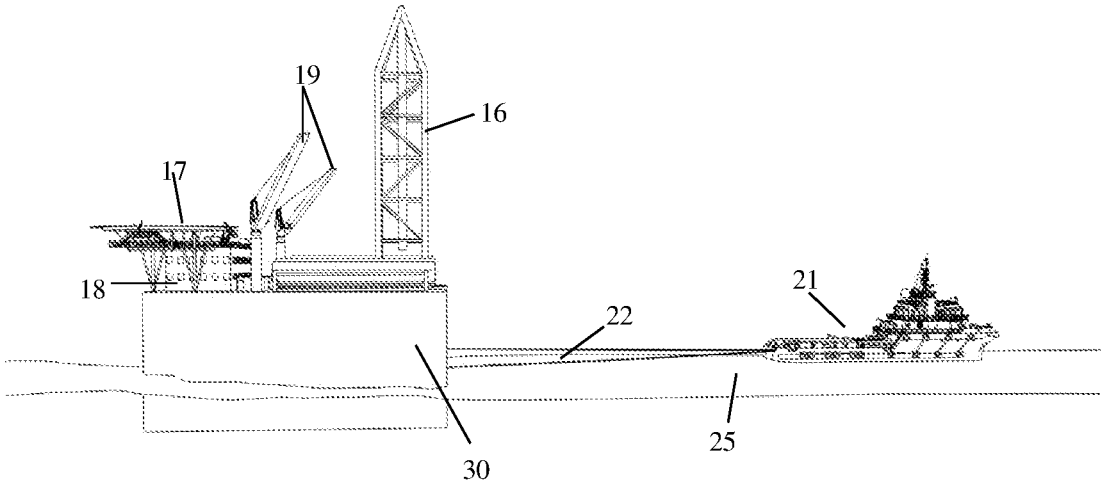
FIG. 6 shows schematically a drilling unit according to one embodiment of the invention, towed by a towing vessel towards the site with the installed base structure.
Figure 7:
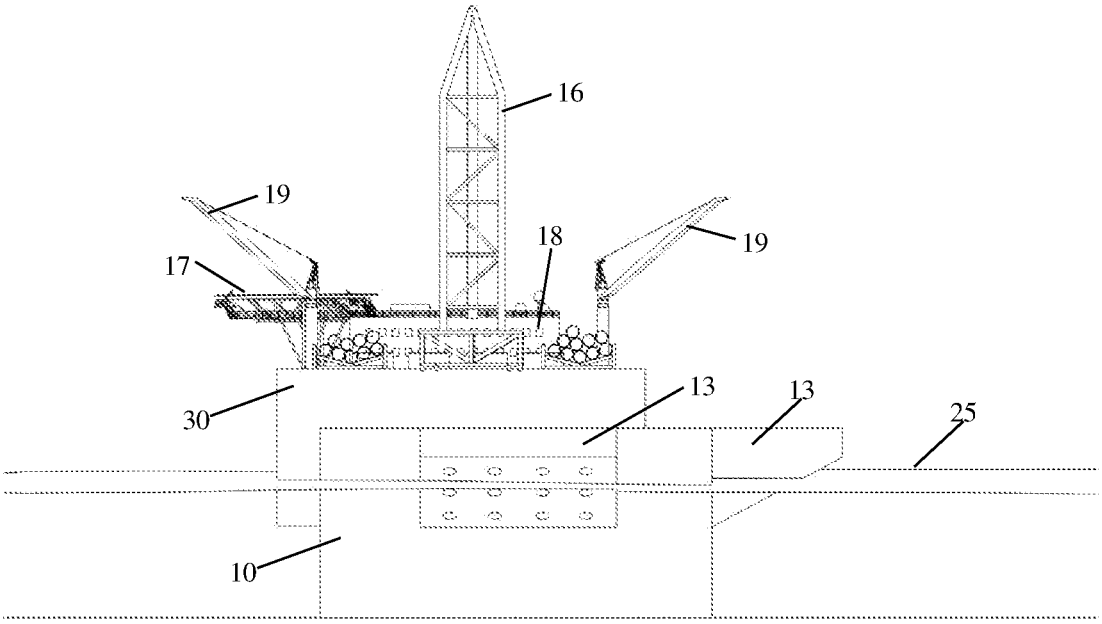
FIG. 7 shows schematically the base structure where the drilling unit is in the process of drilling wells through a first cantilevered structure according to the present invention process of berthing the drilling unit shown in FIG. 6 on the base structure.

FIG. 6 shows schematically a drilling unit 30 being towed by a towing vessel 21 and towing lines 22 towards the installed base structure 10 for berthing, while FIG. 7 shows schematically a stage where drilling unit 30 is in the process of being berthed inside the designed U-shaped berth of the base structure 10.

Figure 8:
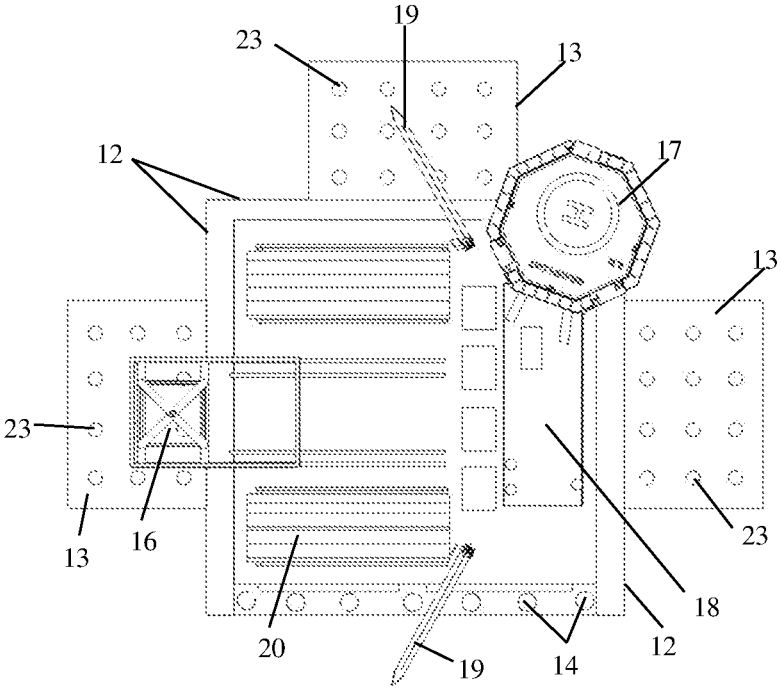
FIG. 8 shows schematically a top view of the base structure with the berthed drilling unit, where the drilling unit is in the process of drilling wells through a first cantilevered structure according to the present invention.

FIG. 8 shows schematically a top view of the base structure 10 with the berthed drilling unit 30, where the drilling unit 30 is in the process of drilling wells 12 through a first cantilevered structure 13, i.e. the cantilever unit 13 on the left side of the drawing. As indicated the drilling rig 16 are moveably arranged from a retracted position on the drilling unit 30 to a position extending outwards and also sideways over the holes or openings 23 on the cantilevered unit 13.

Figure 9:
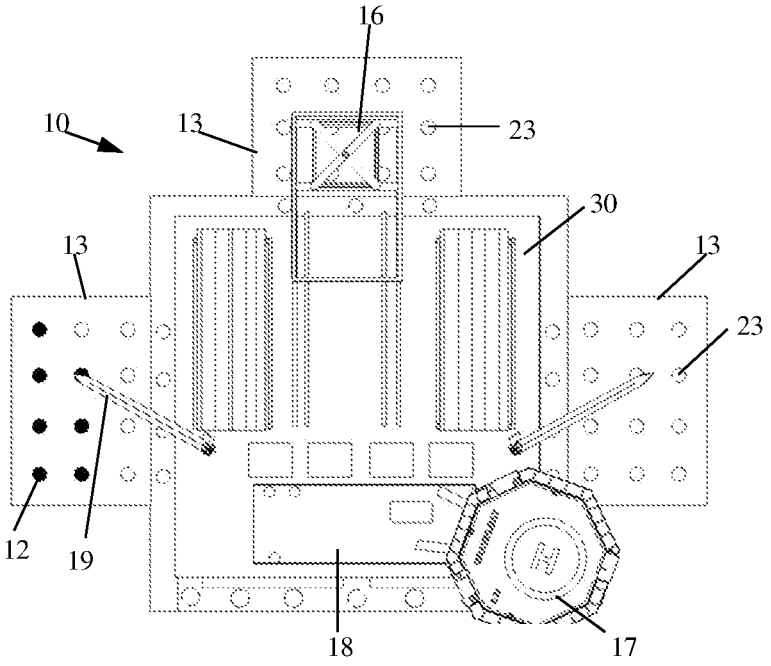
FIG. 9 shows schematically a top view of the base structure with the berthed drilling unit, where the drilling unit is in the process of drilling wells through a second cantilevered structure according to the present invention.

FIG. 9 shows schematically a top view of the base structure with the berthed drilling unit, where the drilling unit is in the process of drilling wells through a second cantilevered structure according to the present invention. In order to arrive from the drilling position shown in FIG. 8 to the drilling position shown in FIG. 9, the drilling unit 30 is de-ballasted so it becomes floating, and then is maneuvered out from its berthing inside the base structure 10, turned 90 degrees around and maneuvered back into its berthing position inside the base structure 10 and the ballasted again to become stably supported by the base structure 10. The drilling rig 16 is then brought to a drilling position over the second cantilevered unit 13. It should be noted that the openings marked with black colour on the cantilevered unit 13 to the left on FIG. 9, represent completed wells 12, awaiting connection to a production facility. It should be appreciated that such wells may at this stage be provided with blowout preventor (BOP) stacks and wellheads, etc.

Figure 10:
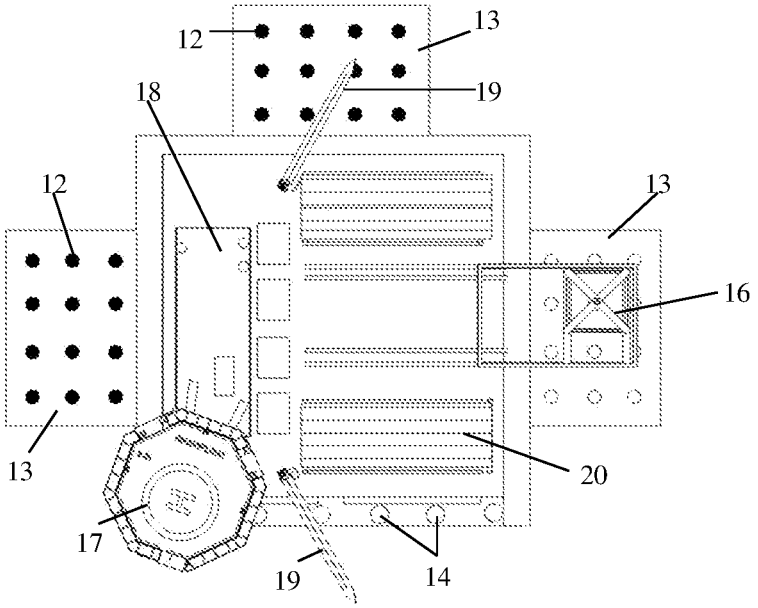
FIG. 10 shows schematically a top view of the base structure with the berthed drilling unit, where the drilling unit is in the process of drilling wells through a third cantilevered structure according to the present invention.

FIG. 10 shows schematically a top view of the base structure 10 with the berthed drilling unit 30, where the drilling unit 30 is in the process of drilling wells 12 through a third cantilevered structure 13 according to the present invention. Again, change of position from the second cantilevered unit 13 to the third cantilevered unit 13 is performed as described above.

Figure 11:
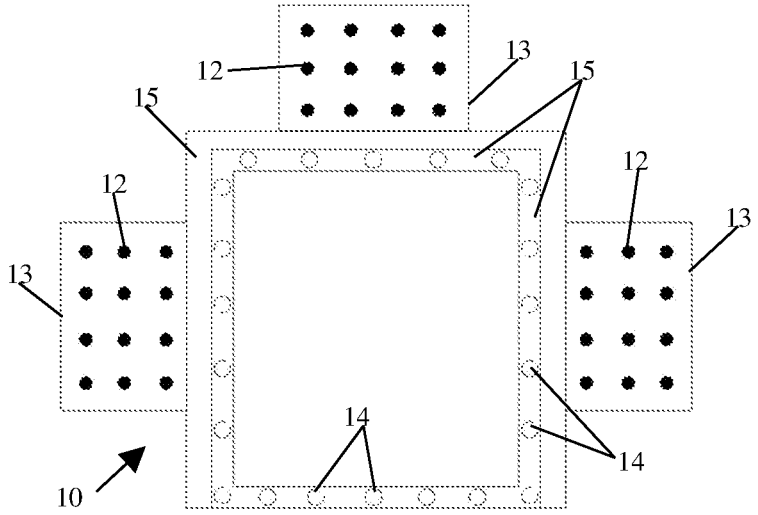
FIG. 11 shows schematically a top view of the base structure, with the berthed drilling unit removed, also indicated that all the wells have been drilled and completed.

FIG. 11 shows schematically a top view of the base structure 10, with the berthed drilling unit removed—As indicated all the wells 12 have now been drilled and completed.

Figure 12:
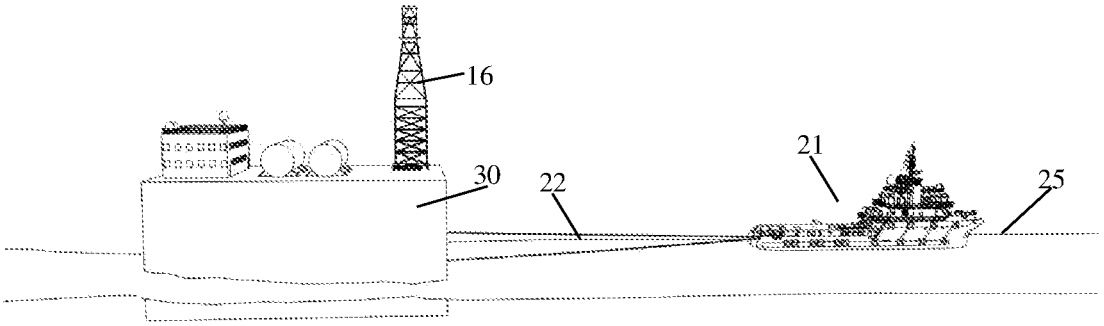
FIG. 12 shows schematically a production unit towed by a towing vessel towards the base structure for berthing.
Figure 13:
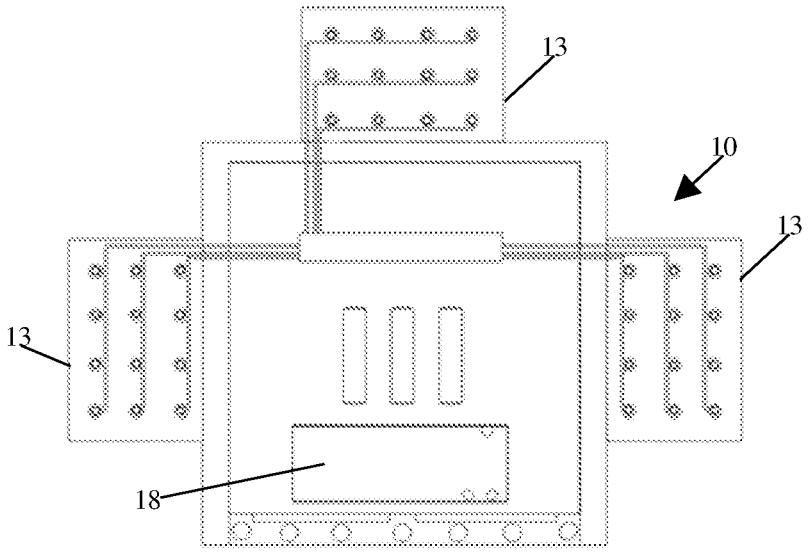
FIG. 13 shows schematically a top view of the base structure with berthed production unit, indication also all the wells are connected to the production facilities on the production unit.

FIG. 12 shows schematically a production unit 50 towed by a towing vessel towards the base structure 10 for berthing and hook-up with the various drilled and completed wells 12, while FIG. 13 shows schematically a top view of the base structure 10 with berthed production unit 50, indicating also that all of the wells 12 are connected to the production facilities on the production unit 50.

Figure 14A:
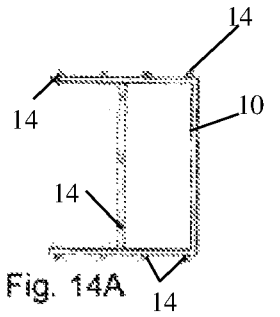
Figure 14B:
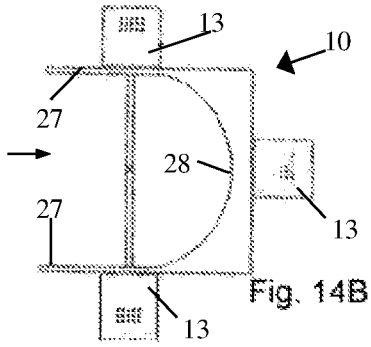
Figure 14C:
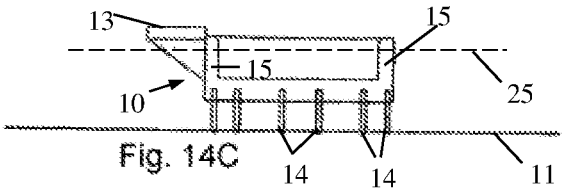
Figure 15A:
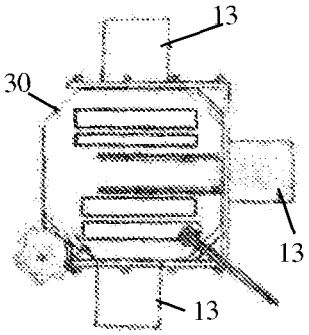
Figure 15B:
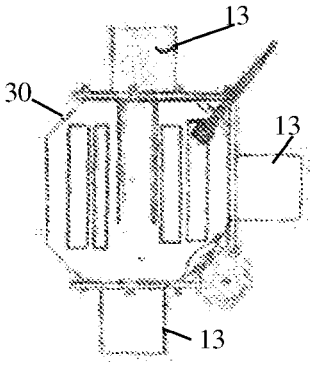
Figure 15C:
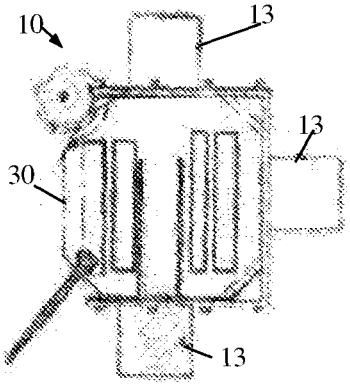
Figure 15D:
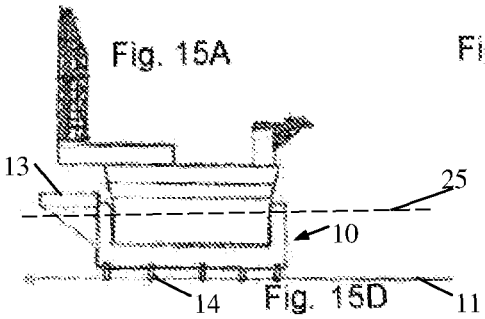

FIGS. 14 A-C show schematically a plan view from above and from one side of an embodiment of a base structure 10 according to the present invention. The base structure is provided with three cantilevered parts 13 as described above and with a berthing space being U-shaped with a curved end part 28 and straight wings 27, extending out from the end part 28, also forming sideways protection. The base structure 10 is installed on the seabed 11, mounted on piles 14, the bottom slab of the base structure 10 being positioned above the seabed 11. FIG. 14A shows an embodiment where the base structure 10 is given a rectangular shape, while FIG. 14B shows an embodiment where the base structure is configured to receive a floating structure 30 with a circular or polygonal cross sectional area. FIG. 14C shows a vertical view, seen in the direction of the arrow in FIG. 14B.

Once the base structure is installed and securely piled to the seabed, a jacket platform or a jack-up platform may be installed beside the base structure 10, reducing even further the time taken before drilling operations may start and subsequent production of hydrocarbons may be initiated. In such case the floating module to be berthed inside the base structure may be a production module, possibly also with an additional work-over drilling equipment.

FIGS. 15 A-D show schematically views of an alternative shape of the floating structure 30 to be berthed and possible corresponding modifications to the base structure 10, corresponding to the one disclosed for example in FIG. 14A. According to the embodiment shown in FIG. 15, the floating unit 30 has a horizontal cross section with a circular or round shape. Otherwise the deck configuration may be configured in a manner corresponding to the embodiments described above. The drilling rig may be of a type that may be skidded out on a cantilever to come in position over the preinstall drilling casings in the cantilever unit 13. Once the wells have been drilled through the cantilever unit 13 shown in FIG. 15A, the floating unit is de-ballasted so it becomes floating, towed out and turned 90 degrees and moved back to the base and ballasted, whereupon drilling through the preinstalled drilling casings in the cantilevered unit 13 may start, ref. FIG. 15B. The same sequence is repeated for establishing wells in the last of the three cantilevered units 13, ref. FIG. 15C.

It should be appreciated that the mating or berthing procedure for mating or berthing the drilling unit 30 or the production unit 50 may be as follows:

The drilling or production/storage module 30, 50 is floating and has means for ballasting (not shown) and is preferably made from steel, although also other materials can also be used such as concrete. It should be appreciated that the respective module 30, 50 according to the present invention also may be provided with means, such as loading systems, cranes, winches etc. on top of the storage module. When the unit 30, 50 arrives at the site, it is mated with the seabed base structure 10 supported by the seabed 11. During this mating operation, the floating unit 30, 50 is maneuvered in through the opening 15' and in between the two parallel upwards extending side wall structures 15. The wall structure 15 of the seabed base structure 10 is extending up above the water surface 25 and the unit 30, 50 is ballasted until the floating unit 30, 50 is positioned on top of the bottom beam/slab 24 on the base structure 10, within the wall structure 15. The unit 30, 50 is the ballasted so that module 30, 50 rests stably on the base of the seabed substructure 10, forming a seabed assembled unit.

FIG. 16 shows schematically a view in perspective of an alternative solution where the drilling rig 16 is arranged on a cantilever rail system 26, where both the drilling rig 16 and cantilever rail system 26 also may be rotated around a vertical axis of rotation, so that instead of floating the drilling unit 30 out and turning 90 degrees in order to be able to drill at a second cantilever unit 13 (not shown in FIG. 16), the drilling unit 30 may be maintained in its initial position, while the drilling rig 16 and the rail system 26 may be rotated in either two of the directions indicated by the arrow 27. Instead of moving out and in in linear direction on a rail system, the drilling derrick may be skidded out and in.

It should be appreciated that the wells piles may extend vertically down into the seabed or, they may be arranged inclined with respect to the vertical, either in same direction, inwards or outwards, or a combination of the same. Moreover, directional drilling may be performed from the drilling unit 30.

It should be noted that although the disclosed seabed structure is given a rectangular footprint, the shape of the base structure may have a circular, U-shaped or polygonal footprint without thereby deviating from the inventive concept. Moreover, the shape of the berthing area may be given a shape complementary to the shape of the floating module to be berthed, or vice versa.

The drilling rig may be skidded along the cantilever or moved on rails or the like, enabling movement both in longitudinal and/or transverse direction.

The helideck and/or the crane on the drilling module (30) should preferably be positioned at a corner in order to avoid conflict, preferably at opposite or adjacent corners.

The invention claimed is:

1. A seabed supported unit for drilling and production of hydrocarbons, comprising a seabed supported base structure (10) positioned and fixed with respect to a sea bed (11), forming a support for a floatable drilling unit (30) and/or a floatable production unit (50), characterized in that the base structure (10) is provided with buoyancy devices, an upwards extending wall structure (15) extending around the base structure (10) along three sides, thereby leaving an opening (15') along a fourth side of the base structure (10) for introducing the floatable drilling and/or production unit (30, 50), retractably arranged on top of the base structure (10) and within the upwards extending wall structure (15), and the upwards extending wall structure (15) is provided with one or more cantilever units (13) each extending laterally out from an exterior side of the upwards extending wall structure (15), each cantilever unit having prepared well points for drilling of wells (12) and terminating above sea level (25), forming a structurally integrated part with the upwards extending wall structure (15).

2. A seabed supported unit according to claim 1, wherein the base structure (10) has a U-shape and the upwards extending wall structure (15) has straight side surfaces.

3. A seabed supported unit according to claim 2, wherein the prepared well points are openings (23) having walls or casings, configured to enable drilling through.

4. A seabed supported unit according to claim 3, wherein one cantilever unit is arranged on each of three exterior sides of the upwards extending wall structure (15).

5. A seabed supported unit according to claim 2, wherein one cantilever unit is arranged on each of three exterior sides of the upwards extending wall structure (15).

6. A seabed supported unit according to claim 1, wherein one cantilever unit is arranged on each of three exterior sides of the upwards extending wall structure (15).

7. A seabed supported unit according to claim 1, wherein the base structure (10) has perforations for piling (14) through the base structure (10) and/or along the upwards extending wall structure (15) extending from the top of the upwards extending wall structure (15) through the bottom of the upwards extending wall structure (15).

8. A seabed supported unit according to claim 1, wherein the opening (15') in the upwards extending wall structure (15) is closable.

9. A seabed supported unit according to claim 8, wherein the base structure (10) is divided into a number of bulkheads, each having a corresponding bulkhead in the floatable drilling unit (30), and vertical walls of each bulkhead of the base structure (10) forms a structural beam so that vertical forces of the floatable drilling unit (30) are transferred directly into the structural beams of the base structure (10).

10. A seabed supported unit according to claim 1, wherein the floatable drilling unit (30) is provided with an outrigger supporting drilling facilities required for drilling operations, wherein the drilling facilities include a drilling device; the drilling device being moveably arranged on the outrigger.

11. A seabed supported unit according to claim 1, wherein the prepared well points are openings (23) having walls or casings, configured to enable drilling through.

12. A method to provide a shallow water drilling terminal, the method comprising towing at least one prefabricated floating seabed substructure (10) to a site, ballasting and/or piling the at least one prefabricated floating seabed substructure (10) to rest on a seabed (11) towing to the site at least one prefabricated floating drilling module (30) provided with an outrigger with a sidewise movable drilling device, guiding the at least one prefabricated floating drilling module (30) into the seabed substructure (10) through an opening (15') in a wall structure (15) at the periphery of the seabed substructure (10), ballasting and mating the at least one prefabricated floating drilling module (30) onto the seabed substructure (10), and drilling wells (12) with a drilling gear (16) on the outrigger, wherein the wall structure (15) is provided with one or more cantilever units (13) each extending laterally out from an exterior side of the wall structure (15), each cantilever unit having a plurality of prepared well points for drilling through, and the drilling gear (16) is moved sideways on to the outrigger and over each prepared well point in turn to drill the wells.

13. The method according to claim 12, further comprising de-ballasting and floating out the at least one prefabricated floating drilling module (30), turning the at least one prefabricated floating drilling module (30) 90 degrees, guiding the at least one prefabricated floating drilling module (30) back into the opening (15') in the seabed substructure (10), and initiating drilling activities at a new location on the seabed supported substructure (10).

14. The method according to claim 12, further comprising de-ballasting and de-berthing of the at least one prefabricated floating drilling module (30), and towing-out and 90 degrees turning and re-berthing of the at least one prefabricated floating drilling module (30), thereby enabling drilling of wells through prepared well points on the cantilever unit extending laterally out from the adjacent exterior side of the wall structure (15) of the seabed substructure (10).

* * * * *